United States Patent [19]

Campagnuolo et al.

[11] 4,027,593

[45] June 7, 1977

[54] MULTI-DIRECTIONAL SYSTEM FOR ELECTRICAL BOMB FUZES

[75] Inventors: Carl J. Campagnuolo, Potomac, Md.; Earl T. Smith, Ft. Walton Beach; Ronald L. Dale, Destin, both of Fla.

[73] Assignee: The United States of America as represented by the Secretary of the Army, Washington, D.C.

[22] Filed: Feb. 12, 1976

[21] Appl. No.: 657,417

[52] U.S. Cl. ..... 102/70.2 G

[51] Int. Cl.[2] ..... F42C 11/00

[58] Field of Search ..... 102/70.2 G, 81, 81.2

[56] References Cited

UNITED STATES PATENTS

| | | | |
|---|---|---|---|
| 3,757,695 | 9/1973 | Fisher | 102/70.2 G |
| 3,861,312 | 1/1975 | Held et al. | 102/70.2 G |
| 3,960,086 | 6/1976 | Fisher | 102/70.2 G |
| 3,961,577 | 6/1976 | O'Steen | 102/70.2 G |

*Primary Examiner*—Charles T. Jordan
*Attorney, Agent, or Firm*—Nathan Edelberg; Robert P. Gibson; Saul Elbaum

[57] ABSTRACT

A charging device for electric bomb fuzes which may be oriented in more than one direction relative to the direction of movement of the bomb and still be fully operable. The device precludes the occurrence of accidental duds based on mis-orientation of the charging device with respect to the direction of travel of the bomb. The multi-directional charging device includes a unique dual inlet port and outlet port structure by means of which slipstream air may travel in either of two directions through the charging device to successfully actuate the electrical energy transducer positioned therein.

3 Claims, 5 Drawing Figures

MULTI-DIRECTIONAL SYSTEM FOR ELECTRICAL BOMB FUZES

RIGHTS OF THE GOVERNMENT

The invention described herein may be manufactured, used, and licensed by or for the United States Government for governmental purposes without the payment to us of any royalty thereon.

BACKGROUND OF THE INVENTION

1. Field of the Invention

The present invention is directed towards environmental charging systems for electric bomb fuzes and, more particularly, to a structural improvement and modification of a standard charging device for electric bomb fuzes which greatly increases the reliability thereof.

2. Description of the Prior Art

U. S. Pat. No. 3,757,695 to Evan D. Fisher is illustrative of a presently utilized environmental charging system for electric bomb fuzes which has widely replaced the outdated and more complex external charging equipment previously required for providing electrical energy to the fuzing system of the bomb.

The environmental charging system disclosed in the Fisher patent basically comprises a slipstream-actuated charging device threadedly mounted within the former charging well located along the longitudinal periphery of the bomb surface. The standard charging device therein described includes a lanyard-operated pop-up cover which is released soon after the bomb is released from the aircraft. The pop-up cover, when fully extended, positions an inlet port thereof in the slipstream of air flowing along the longitudinal surface of the bomb. This slipstream of air is directed from the inlet port to actuate either a rotatable turbine or a fluidic generator for transducing the slipstream energy into electrical energy which is, in turn, transmitted to the fuze electronics positioned elsewhere.

The pop-up cover of the charging device necessarily includes an exhaust port through which the slipstream air is vented to atmosphere after use. As a safety feature, the exhaust vent is positioned at the lower portion of the pop-up cover such that the latter must be fully extended in order for the vent to clear the bomb surface and thereby create an open fluid conduit for the air to pass. This serves as a safety feature inasmuch as without full extension of the pop-up cover, which can only occur upon positive release and separation of the bomb from the aircraft, the device is not operable.

However, the structural positioning of the inlet and exhaust ports of the device set forth in the Fisher patent has led to several deficiencies. In particular, in the installation of the Fisher charging device it is absolutely necessary for successful operation for the inlet port to be positioned in the proper orientation relative to the nose and tail of the bomb. That is, the inlet port must be positioned in a direction facing the nose of the bomb to ensure that after release and actuation of the pop-up cover, the slipstream of air, which flows along the bomb's surface from the nose to the tail, is fully and properly admitted. Other orientations of the inlet port, particularly one in which it faces the tail of the bomb, was found to lead to possible duds due to the lack of admissible slipstream air, and therefore are unacceptable.

Inasmuch as the inlet and exhaust ports of the pop-up cover are not readily visible during installation of the Fisher charging device, since the pop-up cover is not yet extended, the personnel who install the devices on the bombs were found to be prone to misorienting the device with respect to the nose and tail of the bomb. Thus, there is a need for a charging device of the character described which obviates the possibility of duds in the event of accidental mis-installation or mis-orientation of the charging device.

OBJECTS AND SUMMARY OF THE INVENTION

Accordingly, it is a primary object of the present invention to provide a charging device for an electrically fuzed bomb which overcomes all of the disadvantages noted above with respect to prior art charging devices.

Another object of the present invention is to provide an environmental charging system for electric bomb fuzes by means of which increased reliability in operation is obtained.

A still further object of the present invention is to provide an improvement to existing environmental charging systems for use with electric bomb fuzes by means of which difficulties encountered with respect to misorientation and mis-installation of prior art devices are obviated.

A still further object of the present invention is to provide an environmental charging system for use with electric bomb fuzes which may be installed in either of two basic orientations with respect to the nose and tail of the bomb and still provide successful operation.

An additional object of the present invention is to provide an improved design of an inlet port and an outlet port for a pop-up cover of an electric bomb fuze charging system which de-emphasizes the criticality of proper orientation of the charging system upon installation.

The foregoing and other objects are achieved in accordance with one aspect of the present invention through the provision of an improvement to a charging device for an electrically fuzed bomb. The charging device generally includes a lanyard-operated pop-up cover having housed therein means for converting slipstream air to electrical energy. Such electrical energy conversion means may comprise, as is well known, an anemometer-type turbine driving an alternator. The improvement thereto, which permits the charging device to be installed in either of two basic and diametrically opposite orientations, comprises inlet port means and outlet port means oppositely located in the pop-up cover such that they serve respectively as receiving and exhausting means for the slipstream air when the device is mounted in the bomb in a first orientation, and also serve respectively as slipstream air exhausting means and receiving means when the charging device is mounted in the bomb in a second orientation. The second orientation is broadly defined as being rotated 180°relative to the first orientation, although it is understood that a broad range of orientations of the pop-up cover will still allow proper reception and exhaust of the slipstream air.

In accordance with other aspects of the present invention, the pop-up cover of the charging system includes a cylindrical side wall and a substantially flat top plate. The inlet and outlet are embodied as oppositely located openings in the cylindrical side walls. Positioned between the openings and extending downwardly from the top plate is a diverting vane positioned with respect to the inlet opening approximately two-thirds of the distance rearwardly thereof. The diverting vane serves to divert the incoming slipstream air from the inlet port when the device is positioned in its first orientation so as to impinge upon the rotating turbine at an angle of approximately 90°. When the device is mounted in the bomb in the second orientation, rotated 180° with respect to the first orientation, and the outlet port serves to receive the incoming slipstream of air, the diverting vane serves to divert the incoming slipstream to impinge upon the turbine blades at an angle of approximately 45° with respect to the rotational plane thereof.

BRIEF DESCRIPTION OF THE DRAWINGS

The foregoing and other objects, aspects, uses and advantages of the present invention will be more fully appreciated as the same becomes better understood when considered in connection with the following detailed description of the present invention and in conjunction with the accompanying drawings, in which.

DETAILED DESCRIPTION OF THE PREFERRED EMBODIMENT

Figure 1:
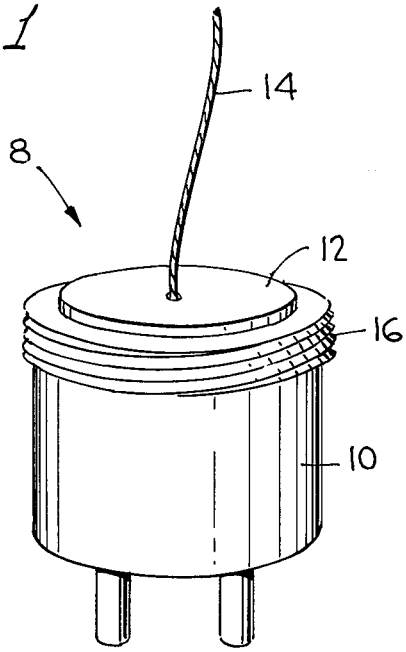
FIG. 1 is a perspective view of a preferred embodiment of the improved environmental charging device in its pre-actuated condition in accordance with the present invention.

Referring now to the drawings, wherein like reference numerals designate identical or corresponding parts throughout the several views, and more particularly to FIG. 1, the charging device of the present invention is indicated generally by the reference numeral 8.

The charging device 8 comprises a lower housing 10 which contains a pop-up cover 12 therein prior to release. Housing 10 has formed along the upper circumference thereof threads 16 for mounting the housing 10 within a similarly threaded portion of the bom 18 (see FIG. 3).

Attached to the central portion of pop-up cover12 is an arming lanyard 14. The other end of arming lanyard 14 is secured in a conventional manner to the aircrafts's bomb rack. Upon release of the bom 18 from the bomb rack, arming lanyard 14 is eventually made taut and acts to release pop-up cover 12 from its position within housing 10 of charging device 8 in a manner which may be considered conventional for the purposes of the present invention.

It should be noted only that in the state of operation of charging device 8 depicted in FIG. 1, which occurs prior to the release of the bomb from the aircraft, there are no exposed vents, either inlet or outlet, through which a fluid circuit may be established for actuating the internal components of the device 8. Thus, charging device 8 is completely inoperative and there is no danger whatsoever of the electrical fuze being accidentally provided with electrical energy.

Figure 2:
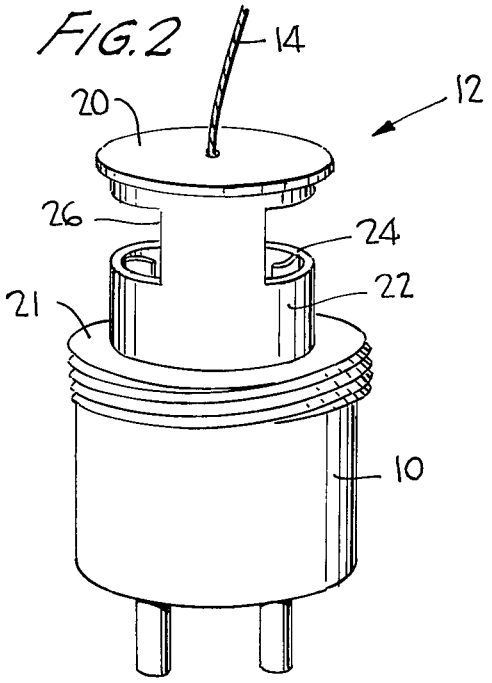
FIG. 2 is a perspective view of the device shown in FIG. 1 after the pop-up cover has been released.

Referring now to FIG. 2, the charging device 8 of the present invention is shown in its post-bomb release position. In this state, arming lanyard 14 has acted to release pop-up cover 12 from its position within housing 10. Pop-up cover 12 extends fully to expose an air inlet port 24 and an air inlet port 26.

More particularly, pop-up cover 12 is seen to comprise a substantially cylindrical housing 22 whose upper portion is covered by a substantially flat top plate 20. Arming lanyard 14 is secured to top plate 20 by conventional means.

Air inlet port 24 and air outlet port 26 are substantially diametrically opposed on cylindrical wall 22 of pop-up cover 12, the symmetry of the positioning thereof being notable. It is also noted, in contrast to prior art designs, that both inlet port 24 and outlet port 26 are located substantially above the rim 21 of housing 10 in order to provide both ports clearly within the slipstream of air flowing along the longitudinal surface of the bomb 18.

Figure 3:
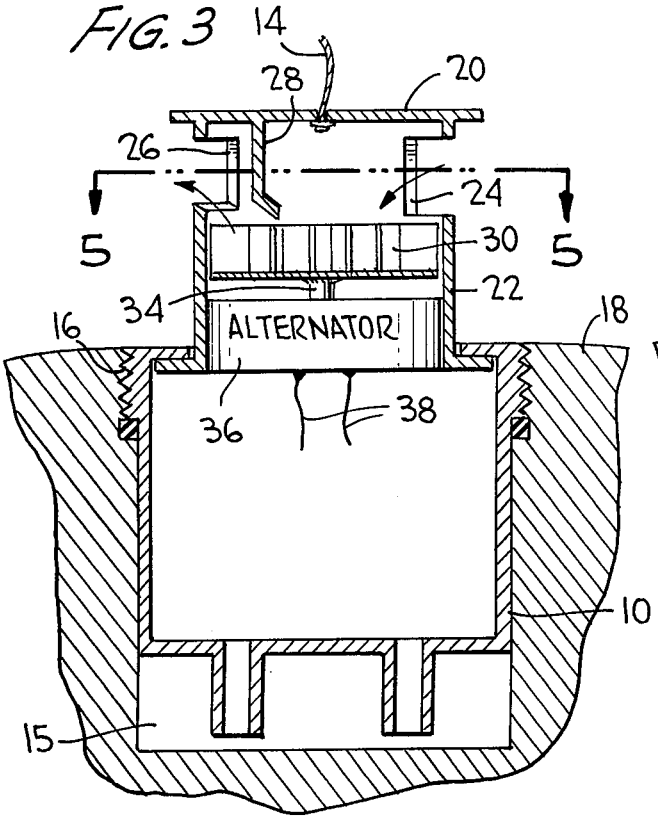
FIG. 3 is a side sectional view of the preferred embodiment of the present invention in a first orientation.

This is illustrated more clearly in FIG. 3 which depicts a side section of the charging device components mounted within bomb 18 by means of threads 16. The particular orientation of the charging device 8 illustrated in FIG. 3 may be considered to consist of a first basic orientation wherein air inlet port 24 is oriented towards the front of the bomb 18, whereas air outlet port 26 is directed towards the tail of bomb 18.

Figure 5:
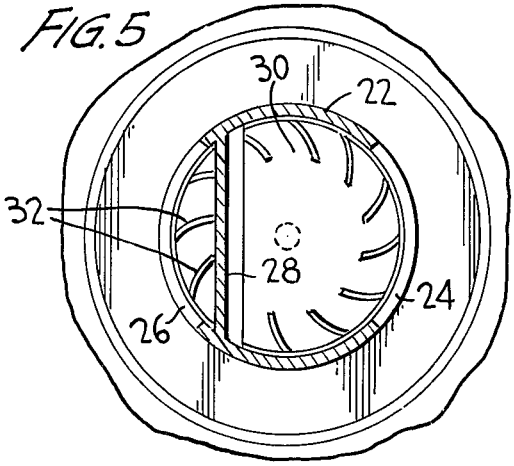
FIG. 5 is a sectional top view taken along line 5—5 of FIG. 3.

The internal structure of the charging device 8 of the present invention is also illustrated in FIG. 3. Cylindrical wall 22 houses means for converting slipstream air to electrical energy. This means preferably takes the form of an anemometer type turbine 30 which includes a plurality of vanes 32 (FIG. 5) mounted on the periphery thereof, and which is rotatable about a centrally positioned shaft 34. The rotation of turbine 30 acts to generate electrical energy within an alternator 36, all of which is conventional. Connected to alternator 36 are a pair of electrical outlet leads 38 for coupling out the electrical energy generated thereby. The electrical energy may be utilized in a conventional manner to power other electronic circuits for a proximity fuze, or the like.

The internal structure of pop-up cover 12 is seen more clearly in FIG. 3 to include a diverting vane 28 extending downwardly from the top plate 20 of the pop-up cover 12. Diverting vane 28 is preferably positioned on top plate 20 approximately two-thirds of the way rearwardly of the inlet opening 24. In this manner, diverting vane 28 acts to divert the slipstream of air incoming through inlet port 24 downwardly at approximately a 90° angle with respect to the plane of rotation of turbine 30. In this manner, turbine 30 is effectively rotated, in the usual manner, to generate electrical energy in response to slipstream air, and the exhaust air is vented through air exhaust port 26 in the manner indicated by the arrows.

It is understood that the orientation of the pop-up cover 12, and indeed that of the entire charging device 8, depicted in FIG. 3, is such that the inlet port 24 is oriented towards the front of the bomb 18 so as to substantially receive the entire slipstream of air and transmit same through turbine 30 to exhaust port 26. The configuration illustrated in FIG. 3 is the standard preferred orientation of the inlet and exhaust ports 24 and 26, but not necessarily the only orientation thereof which will result in proper operation.

Figure 4:
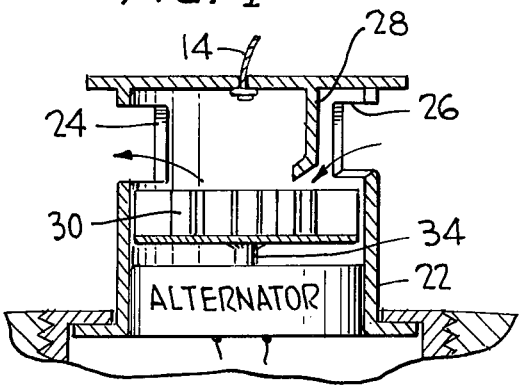
FIG. 4 is an illustration of the preferred embodiment shown in FIG. 3 but in a second orientation rotated 180° relative to the first orientation.

Referring now to FIG. 4, there is illustrated an alternative orientation of the charging device 8 of the present invention wherein the exhaust port 26 (in name only) is now oriented, perhaps through inadvertence, towards the front of bomb 18. In this orientation, the airflow through ports 26 and 24 is reversed with respect to the orientation illustrated in FIG. 3. Diverting vane 28 of pop-up cover 12 serves to direct the incoming slipstream air downwardly so as to impinge upon turbine 30 at a 45° angle with respect to the plane of rotation thereof. The direction of airflow is graphically illustrated by the arrows in FIG. 4.

Significant to the development of the configuration of the inlet and outlet ports according to the present invention is the knowledge developed during experimentation that the vanes 32 of the turbine 30 will work equally well, i.e., be rotated at the required angular velocity, if air impinges upon turbine 30 at either a 90° or 45° angle, as depicted in FIGS. 3 and 4, respectively. In contrast, impingement of air at an angle substantially parallel to the plane of turbine 30 was found to result in very poor, if any, rotation thereof, which contributed to the high dud rate in the prior art configurations described hereinabove.

It is seen therefore by virture of the foregoing that we have provided a dual mode inlet and outlet port configuration by means of which the orientation of the entire charging device may be randomly selected by unskilled personnel in a manner not critical to the subsequent performance of the device. The inlet and outlet ports 24 and 26, which may reverse functions according to the random orientation of charging device 8, may be designed so that a substantial amount of slipstream air will be input regardless of the specific final orientation, it being understood that the two orientations depicted in FIGS. 3 and 4 are for illustrative purposes only. Accordingly, by virture of the present invention, reliability is increased and the possibility of accidental mis-installation of the charging device is minimized.

Obviously, numerous modifications and variations of the present invention are possible in light of the above teachings. We therefore do not wish to be limited to the exact details of construction shown and described, for obvious modifications will occur to a person skilled in the art.

We claim as our invention:

1. A charging device for an electrically fuzed bomb, said charging device capable of being mounted in a first or a second orientation approximately 180° rotated with respect to one another, comprising:

a lanyard-operated pop-up cover including a cylindrical side wall and a flat top plate;

inlet port means and outlet port means oppositely located in said cylindrical side wall for respectively receiving and exhausting slipstream air when said device is mounted on said bomb in said first orientation, the position of said outlet in said second orientation coinciding with the position of said inlet in said first orientation, whereby said inlet and outlet port means serve to respectively exhaust and receive slipstream air when said charging device is mounted in said bomb in said second orientation:

energy converting means for converting slipstream air energy to electrical energy housed in said pop-up cover, said energy converting means comprising a rotatable turbine having a plurality of vanes positioned thereon, said vanes being rotatable by said slipstream air passing between said inlet port means and said outlet port means;

said inlet port means includes means for directing slipstream air onto said rotatable turbine at an angle substantially transverse to the rotational plane of said turbine when said charging device is mounted in said first orientation; and said outlet port means includes means for directing slipstream air onto said rotatable turbine at an angle of approximately 45° with respect to the rotational plane of said turbine when said charging device is mounted in said second orientation.

2. The charging device improvement as set forth in claim 1, wherein said slipstream air directing means for both said inlet port means and said outlet port means comprises a diverting vane extending downwardly from said top plate of said pop-up cover.

3. The charging device improvement as set forth in claim 2, wherein said diverting vane is located between said two openings on said top plate at a position approximately two-thirds of the way rearwardly of said inlet port means opening.

* * * * *